United States Patent [19]

Beckmann

[11] 4,185,874

[45] Jan. 29, 1980

[54] LONGWALL INSTALLATION WITH CARRIER FOR WATER AND ELECTRIC SUPPLY AND PROPULSION ROCK

[75] Inventor: Klaus Beckmann, Lunen, Fed. Rep. of Germany

[73] Assignee: Gewerkschaft Eisenhutte Westfalia, Lunen, Fed. Rep. of Germany

[21] Appl. No.: 927,204

[22] Filed: Jul. 24, 1978

[51] Int. Cl.[2] ..... E21C 27/36

[52] U.S. Cl. ..... 299/32; 299/43; 299/34

[58] Field of Search ..... 299/32, 34, 43

[56] References Cited

U.S. PATENT DOCUMENTS

| | | | |
|---|---|---|---|
| 4,025,118 | 5/1977 | Lanfermann et al. | 299/43 |
| 4,067,257 | 1/1978 | Pentith | 299/43 X |
| 4,072,355 | 2/1978 | Pentith | 299/43 |

FOREIGN PATENT DOCUMENTS

| | | | |
|---|---|---|---|
| 1508788 | 4/1978 | United Kingdom | 299/43 |
| 1518542 | 7/1978 | United Kingdom | 299/43 |

*Primary Examiner*—Ernest R. Purser
*Attorney, Agent, or Firm*—Sughrue, Rothwell, Mion, Zinn and Macpeak

[57] ABSTRACT

A mineral winning installation employs a longwall scraper chain conveyor at the mineral face with roof supports arranged at the goaf side of the conveyor. A winning machine, such as a shearer or plough, moves back and forth alongside the mineral face to skim or cut mineral. The machine carries its own drive means which is electrically powered and which drives a pinion, for example, meshing with a toothed rack. An independent constructional assembly arranged at the roof or floor has a multi-sectioned rail or plate carrying the toothed rack. In addition, the rail or plate supports a sealed guard housing containing an electric live track and a further sealed housing containing pressurized water. The machine has a pick-up arm which engages with a contact sliding along the electric track to supply electric power to the drive means and a conduit which has a water collector displaceable along the water housing to supply water to the machine for dust suppression.

18 Claims, 6 Drawing Figures

LONGWALL INSTALLATION WITH CARRIER FOR WATER AND ELECTRIC SUPPLY AND PROPULSION ROCK

BACKGROUND OF THE INVENTION

The present invention relates to mineral mining installations.

For winning mineral, and especially coal, it is well known to use a winning machine, such as a plough or a shearer, which is moved along the mineral face and a scraper-chain conveyor. It is usual to provide one or more guides on the conveyor to guide the winning machine. In some installations the machine is driven by a chain which runs at one side of the conveyor. The conveyor can also accommodate other facilities for the machine, such as hydraulic pressure fluid conduits and water supply conduits.

It is also known to provide a different form of propulsion for the machine. In this regard, the machine employs it own drive system which moves a rotatable member or chain, for example, which engages with a fixed track extending along the working. Examples of this form of drive system are described in German Pat. No. 2,547,826 and in U.S. Pat. No. 3,753,596.

To supply power to the mineral winning machine it is also known to utilize a live electric rail in a guard housing. A sliding contact moves along the rail and supplies electric current via a pick-up arm to the machine. An example of this arrangement is described in German Pat. No. 1,515,340. It is also known to supply water to the machine with the aid of a similar arrangement wherein a housing contains water and a collector moves along the housing and supplies water to the machine through a conduit. An arrangement of this type is descibed in U.S. Pat. No. 4,072,355.

In general, the known systems for the supply of facilities to the winning machine are not readily adaptable to enable both shearers and ploughs to be employed and it is not readily possible to have several winning machines supplied simultaneously.

A general object of this invention is to provide an improved installation.

SUMMARY OF THE INVENTION

In a mineral mining installation employing a conveyor and a winning machine movable along the mineral face and conveyor, the invention provides a constructional assembly composed of displaceable carrier means supporting water supply means for the winning machine, electric supply means for the winning machine and a propulsion track which co-operates with a driven component of the drive means of the machine.

An installation made in accordance with the invention enables different winning machines to be employed and the drive and supply means are essentially independnent of the conveyor. The machines can work by skimming or cutting. The term "independent of the conveyor" means that the component parts are not attached to the conveyor even although, in certain embodiments, the conveyor may rest on the carrier means of the constructional assembly. Forces which result from the propulsion and winning work performed by the machine are thus not fully transmitted to the conveyor. The constructional assembly can also supply and propel and guide separate winning machines operating in different regions of the working thereby increasing the mineral output.

The electric supply means capable of supplying propulsive energy to one or several winning machines preferably comprises a housing containing an electric live track engaged by contact means which is carried by a pick-up arm extending between the or each machine and the housing and supplies electric power to the drive means of the or each machine. The housing advantageously contains a pressurized safety gas and resilient sealing means seals off the housing and permits the passage of the or each pick-up arm. In a similar way, the water supply means can take the form of a housing sealed with resilient means containing water under pressure and a collector leads from the housing interior via a conduit to the or each machine.

In one form the propulsion track for the or each machine is a toothed rack and the component driven by the drive means of the or each machine is a pinion or toothed wheel meshing with the track.

The constructional assembly may be disposed at the roof or floor of the working. In the former case, the carrier means, which may be composed of articulated plates or rails, is conveniently suspended from roof bars or similar structures of roof supports of the installation. The constructional assembly may be displaceable as a unit independently of other components of the installation or, alternatively, the assembly may be connected for movement to one or more components such as certain roof bars or floor rails or the like.

It is possible to provide one or more guides for the machine or machines on the constructional assembly. Such a guide or guides may in fact be a separate component or components or the housing(s) of the supply means or of the propulsion track. It may be useful to mount the latter propulsion track on a guide rail supported directly by the carrier means. In another design, the propulsion track and/or the supply means can be located within a guide rail.

Where the constructional assembly is mounted at the floor the propulsion track can be located adjacent the mineral face side of the conveyor while the electric and water supplies are then located at the opposite side of the conveyor. The conveyor can then rest on the carrier means and lie in a channel or trough defined between the supplies and the propulsion track.

Additional devices can also be provided on the constructional assembly. For example, a passage may be defined for receiving hydraulic conduits or for conveying fresh air or for creating a suction to remove gases. Brackets or coupling members can also be built onto the basic assembly.

In one preferred design the present invention provides a conveyor arranged alongside a mineral face, a mineral winning machine; guide means for guiding the machine for movement alongside the mineral face; water conveying means carried by the machine; electric conveying means carried by the machine; drive means powered via the electric conveying means, the drive means being carried by the machine and including a rotatable driven member; a drive track extending alongside the mineral face and engaging with the rotatable member so that rotation of the latter propels the machine along the track; an electric supply comprising a housing containing an electric track; the electric conveying means extending into the housing and slidably contacting the electric track; a water supply comprising a housing containing water, the water conveying means extending into the housing; and a carrier supporting in common the drive track; the water supply and the electric supply.

BRIEF DESCRIPTION OF DRAWINGS

Embodiments of the invention will now be described, by way of examples only, with reference to the accompanying drawings, wherein.

DESCRIPTION OF PREFERRED EMBODIMENTS

Figure 1:
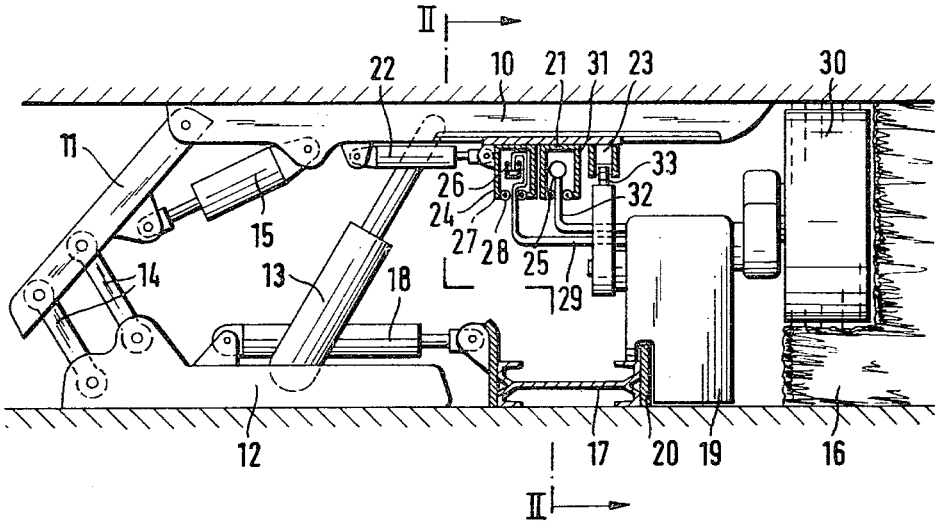
FIG. 1 is a diagrammatic end view of a mineral mining installation made in accordance with the invention.
Figure 2:
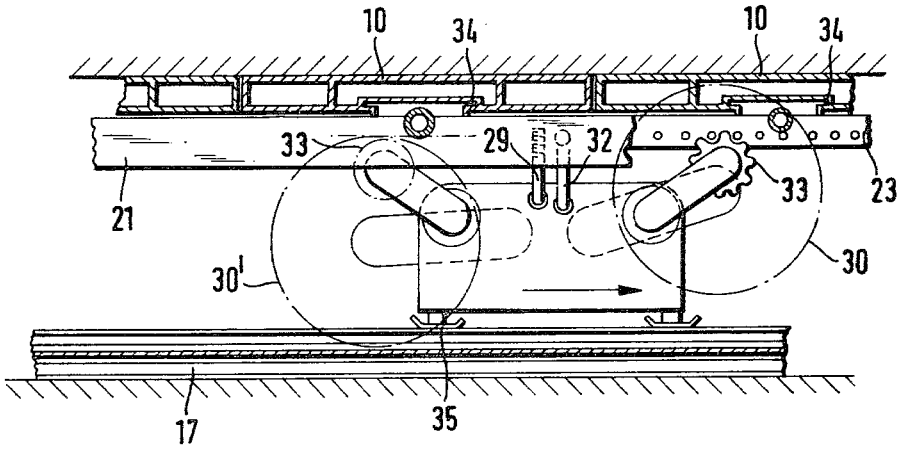
FIG. 2 is a sectional view of part of the installation, shown in FIG. 1, the view being taken along the line II—II if FIG. 1 and in the direction of the mineral face.

As shown in FIGS. 1 and 2 a longwall mineral mining installation employs a longwall scraper-chain conveyor 17 extending alongside the mineral, e.g., coal face. A series of chocks or roof supports are disposed at the side of the conveyor 17 remote from the mineral face. The supports may extend along the entire length of the conveyor or along regions, e.g., at the ends thereof. Each support has a floor-engaging sill 12 and a roof-engaging structure such as a cap 10. One or more hydraulic props 13 are interposed between the floor sill 12 and the roof cap 10 and the, or each, prop 13 is connected to the sill 12 and to the cap 10 with a pivot or articulation joint. A goaf or stowage shield 11 screens off the stowage or waste. The shield 11 is directly pivoted to the roof cap 10 and is connected via pivot levers 14 to the floor sill 12. A hydraulic piston and cylinder unit 15 is connected with pivot joints to the shield 11 and to the roof cap 10. A hydraulic ram 18 is used to relatively displace the support and a section of the conveyor 17. The ram 18 is mounted with pivot joints to the floor sill 12 and to a bracket or plate at the goaf side of the conveyor 17.

A mineral winning machine serves to win the mineral from the face or seam and in this installation the machine takes the form of a shearer which attacks the face with swinging cutting cylinders 30,30'. (FIG. 2) as known per se. The machine 19 is movable back and forth along the face and is guided directly on the conveyor 17 and/or on a separate guide 20 as shown. As depicted in FIG. 2, the machine 19 can also have skids 35 which slidably engage the floor of the working or the conveyor 17. The machine 19 carries its own drive means which is electrically powered.

In accordance with the invention, an independent composite constructional assembly is provided for supplying facilities to the machine 19. In this embodiment, the assembly comprises carrier means in the form of a multi-sectional carrier rail or plate 21 suspended beneath the roof caps 10 of the supports. Slidable guide means is provided between rail 21 and each roof cap 10 to permit the rail 21 and thereby the constructional assembly to be moved towards or away from the mineral face. As shown in FIG. 2, the guide means between the rail 21 and the caps 10 take the form of T-shaped recesses or grooves 34 on the underside of the caps 10 and corresponding shaped guide elements formed on the rail 21. A hydraulic piston and cylinder unit 22 is mounted beneath each roof cap 10 and is connected with pivot joints to the associated cap 10 and to the constructional assembly. At the side nearest the mineral face, the rail 21 carries a propulsion track 23, such as a toothed rack, disposed between side walls forming a protective channel. The machine 19 has a driven member such as a pinion 33 which meshes with the track 23 so that rotation of the pinion causes the machine 19 to move along the conveyor 17. The track 23 may, however, take a variety of forms other than a toothed rack as mentioned. For example, the track 23 can be formed as a slotted or perforated member receiving the pins of a pin wheel instead of the pinion 33. Alternatively, the pinion 33 can be replaced by an apertured wheel meshing with spaced pins constituting the track 23. At the side nearest the goaf, the rail 21 carries an electric supply means 24 for the machine 19. This supply means 24 takes the form of a housing 27 containing a bus bar or the like constituting an electrically live track 26. A pick-up arm 29 conveying electric power to the machine 19 extends into the housing 27 through an opening between resilient seals 28. The seals 28 normally close together to seal off the interior of the housing 27 but open and close progressively as the arm 29 moves along the housing 27.

The arm 29 has a contact shoe which is in sliding contact with the live track 26. The interior of the housing 27 contains gas, which may be air, at a pressure in excess of the surrounding atmosphere to thereby prevent the ingress of hazardous gas, particularly methane, into the housing 27. The electric supply means 24 supplies electric power to drive both the pinion propelling the machine 19 as well as the cutting cylinder 30.

Figure 4:
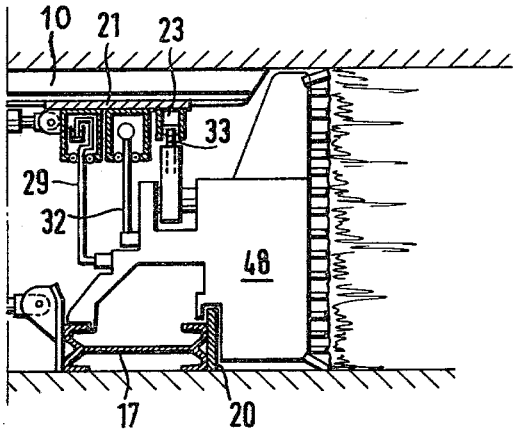
FIG. 4 is a diagrammatic end view of part of a modified form of installation made in accordance with the invention.

Between the propulsion track 23 and the electric supply means 24 there is a further housing 31 constituting water supply means for the machine 19. The housing 31 contains water under pressure and the machine 19 has a conduit or the like 32 which extends into the housing 31 via an opening again provided with resilient seals which act in a similar manner to the seals 28 of the electric supply housing 27. The conduit 32 terminates in the housing 29 at a water collector 25 and the water thus supplied feeds water spray nozzles on the machine 19 for dust suppression purposes. During operation, the machine 19 is driven along the conveyor 17 to detach mineral from the face 16 and the constructional assembly and the conveyor 17 can be advanced by the desired cutting depth by operating the rams 18 and the units 22. The individual roof supports can then be drawn up from time to time by relieving the roof support pressure and by retracting the associated ram 18. Instead of utilizing a shearer as a mineral winning machine, it is possible to utilize a plough which would be similarly equipped with electric drive means. FIG. 4 depicts part of a modified installation constructed in accordance with FIGS. 1 and 2 but utilizing a plouth 48 instead of a shearer 19.

Figure 3:
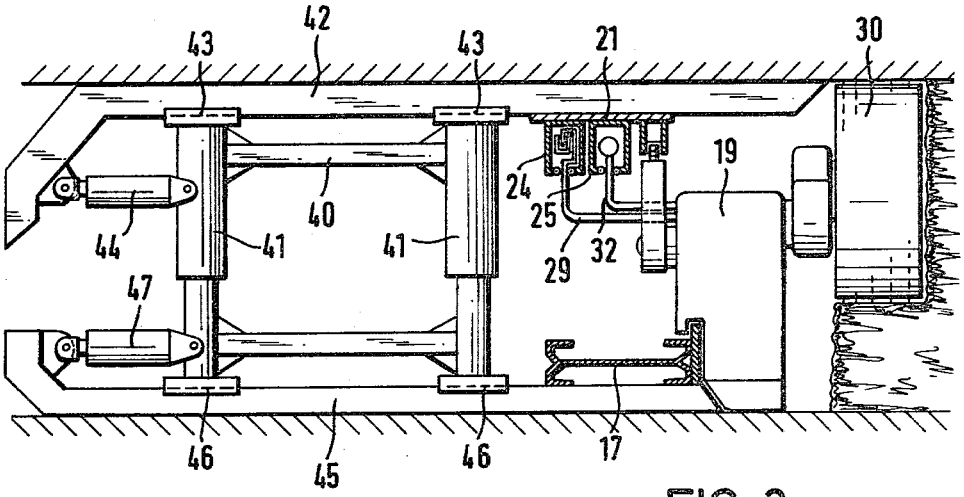
FIG. 3 is a diagrammatic end view of another mineral mining installation made in accordance with the invention.

In the installation depicted in FIG. 3, a shearer 19 is again propelled along a conveyor 17 and the constructional assembly 21, 24, 25 (as described above) is again suspended beneath the roof-engaging parts of the roof supports of the installation. The roof supports are however of modified form as will now be described.

In this embodiment, each support is composed of an angularly-rigid framework 40 with a pair of upstanding props 41 near the conveyor 17 and a pair of upstanding props 41 remote from the conveyor. Bracing beams interconnect the heads and the feet of the props 41. The props 41 of each unit carry a roof-engaging structure which is composed of a number of, usually from three to ten, narrow planks 42 lying closely side-by-side in parallelism. The planks 42 are guided by slidable guides 43 provided at the tops of the props 41. The planks 42 have downwardly-projecting rear portions which are coupled with piston and cylinder units 44 to the rear of the framework 40. The planks 42 can thus be moved individually or in groups with the aid of the units 44 and this can be accomplished without full relief of the props 41. The floor-engaging structure of the support is constructed in a similar fashion to the roof-engaging structure and is again composed of a number of planks 45 arranged side-by-side in parallelism. The planks 45 are guided by slidable guides 46 provided at the bottoms of the props 41. The planks 45 have upwardly-projecting rear portions which are coupled with piston and cylinder units 47 to the rear of the framework 40. Thus, the planks 45 can also be shifted individually or in groups and again this can be accomplished under load.

The carrier means or rail 21 of the constructional assembly 21,24,25 is, in this embodiment, fixed to one or more of the roof planks 42 of each unit so that it is shifted up therewith. The conveyor 17 rests on the forward regions of the floor planks 45 and is connected with at least one of the planks 45 of each unit so that a section of the conveyor 17 can be shifted up with this plank or planks 45. Hence, during operation the planks 42,45 can be progressively advanced thereby shifting the conveyor 17 and the constructional assembly and the framework 40 of each support can be drawn up by retracting all the units 44,47 in unison.

Figure 5:
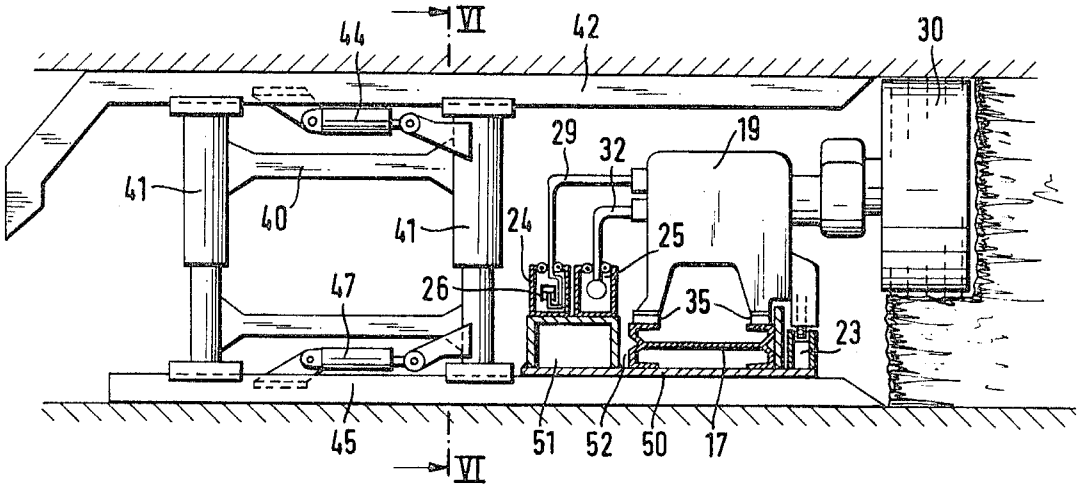
FIG. 5 is a diagrammatic end view of a further mineral mining installation made in accordance with the invention.
Figure 6:
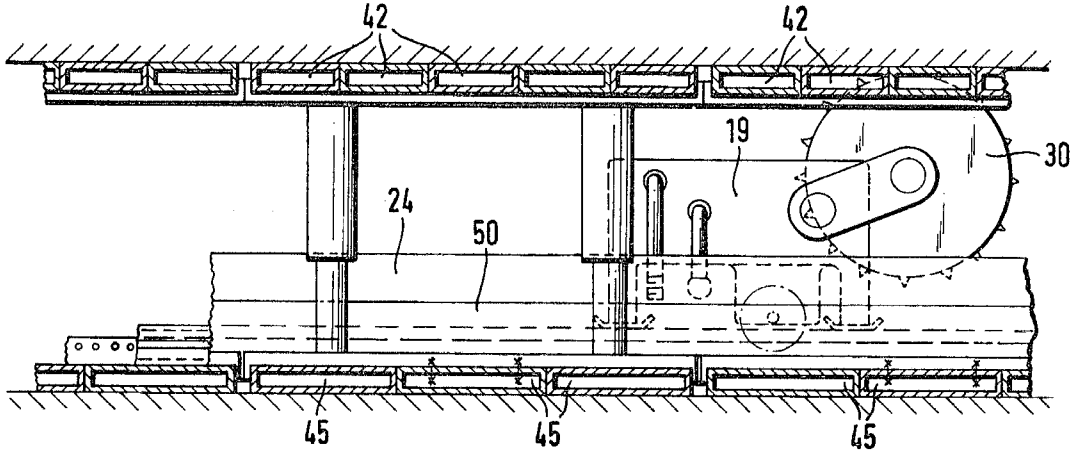
FIG. 6 is a sectional view of part of the installation shown in FIG. 5, the view being taken along the line VI—VI of FIG. 5 and in the direction of the mineral face.

In the installation depicted in FIGS. 5 and 6, the roof supports are constructed in a similar manner to FIG. 4 but the shifting units 44,47 are here disposed between the front and rear props 41 and are coupled to the front props 41.

The assembly providing facilities is in this installation positioned at the floor rather than the roof.

A somewhat wider support plate 50 constitutes the carrier means analogous to the rail 21, and rests on the forward region of the floor planks 45. The plate 50 is connected to at least one plank 45 of each support. The electric supply means 24 and the water supply means 25, constructed as described above, are arranged on an additional support member formed as a hollow housing 51. This housing 51 can serve for accommodating additional cables or conduits pertaining to the installation or for passing fresh air or for sucking out mine gas. The propulsive track 23 is here separated from the electric and water supplies 24,25 and the conveyor 17, which also rests on the planks 45 and is connected to certain of the planks 45, is disposed in a trough or channel 52 formed between the track 23 and the supplies 24,25. The winning machine again takes the form of a shearer 19 additionally guided by skids 35 slidably resting on the conveyor side walls, although a plough could again be adopted.

In all the installations described, it is feasible to provide several winning machines of the same or different types instead of the single machine as illustrated.

In the case of certain winning machines, additional guidance at the roof may be desirable and in the case of the FIGS. 1–4, constructions such as a guide can be conveniently incorporated with the constructional assembly carried by the rail 21.

In a further modification, the conveyor is not used at all for the guidance of the machine used for the winning work and can thus be of somewhat lighter construction.

I claim:

1. In a mineral mining installation comprising a conveyor disposed alongside a mineral face and a mineral winning machine movable in relation to the conveyor to win mineral from the mineral face; the improvement comprising: a constructional assembly independent of and separate from the conveyor, the constructional assembly composed of displaceable carrier means, water supply means for the winning machine mounted on the carrier means, electric supply means for the winning machine mounted on the carrier means, a propulsion track mounted on the carrier means, and a driven components of drive means of the winning machine mounted on the machine and co-operably engaged with the propulsion track.

2. An installation according to claim 1, wherein the electric supply means comprises a housing containing an electric live track engaged by contact-means which is carried by a pick-up arm extending between the machine and the housing and supplies electric power to the drive means.

3. An installation according to claim 2, wherein the housing of the electric supply means contains pressurized gas and there is further provided resilient sealing means which seals off the interior of the housing and which permits the passage of the pick-up arm along the housing.

4. An installation according to claim 1, wherein the water supply means comprises a housing containing water under pressure and a collector which leads via a conduit to the machine.

5. An installation according to claim 4, wherein there is further provided resilient sealing means which seals off the interior of the housing and which permits the passage of the conduit along the housing.

6. An installation according to claim 1, wherein the propulsion track comprises a toothed rack and the driven component as a pinion meshes with the rack.

7. An installation according to claim 1, wherein the conveyor is also supported by the carrier means.

8. An installation according to claim 7, wherein the propulsive track is adjacent the mineral face and the mineral face side of the conveyor and the water and electric supply means are disposed at the opposite side of the conveyor.

9. An installation according to claim 8, wherein the propulsive track and the water and electric supply means define a trough-like channel for accommodating the conveyor.

10. An installation according to claim 1 and further comprising roof supports at the side of the conveyor remote from the mineral face.

11. An installation according to claim 10, wherein the carrier means is suspended from roof-engaging structures of the roof supports.

12. An installation according to claim 11, wherein the carrier means is displaceable in relation to the said roof-engaging structures and guide means is provided between the carrier means and the roof-engaging structures.

13. An installation according to claim 11, wherein each roof support has a plurality of individually-displaceable roof planks constituting said structures and the carrier means is connected for movement with at least one of said roof planks.

14. An installation according to claim 10, wherein the carrier means is supported on floor-engaging structure of the roof supports.

15. An installation according to claim 13, wherein each roof support has a plurality of individually-displaceable floor planks constituting said structures and the carrier means is connected for movement with at least one of said floor planks.

16. An installation according to claim 1, wherein the winning machine is a plough.

17. An installation according to claim 1, wherein the winning machine is a shearer.

18. A mineral mining installation comprising:

a conveyor arranged alongside a mineral face;

a mineral winning machine;

guide means for guiding the machine for movement alongside the mineral face;

water conveying means carried by the machine;

electric conveying means carried by the machine;

drive means powered via the electric conveying means, the drive means being carried by the machine and including a rotatable driven member;

a drive track extending alongside the mineral face and engaging with the rotatable member so that rotation of the latter propels the machine along the track;

an electric supply comprising a housing containing an electric track;

the electric conveying means extending into the housing and slidably contacting the electric track;

a water supply comprising a housing containing water, the water conveying means extending into the housing; and a carrier mounting in common the drive track; the water supply and the electric supply, said carrier being independent of the conveyor and not connected thereto.

* * * * *